US012203189B2

(12) United States Patent
Hirai et al.

(10) Patent No.: US 12,203,189 B2
(45) **Date of Patent: *Jan. 21, 2025**

(54) SILVER-PLATED PRODUCT AND METHOD FOR PRODUCING SAME

(71) Applicant: DOWA METALTECH CO., LTD., Tokyo (JP)

(72) Inventors: Yutaro Hirai, Tokyo (JP); Kentaro Arai, Tokyo (JP); Yosuke Sato, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/024,403

(22) PCT Filed: Mar. 24, 2021

(86) PCT No.: PCT/JP2021/012311
§ 371 (c)(1),
(2) Date: Mar. 2, 2023

(87) PCT Pub. No.: WO2022/059237
PCT Pub. Date: Mar. 24, 2022

(65) Prior Publication Data

US 2023/0313402 A1 Oct. 5, 2023

(30) Foreign Application Priority Data

Sep. 15, 2020 (JP) ..... 2020-154292
Feb. 26, 2021 (JP) ..... 2021-029860

(51) Int. Cl.
*C25D 3/46* (2006.01)
*C25D 5/00* (2006.01)
*C25D 5/12* (2006.01)

(52) U.S. Cl.
CPC ..... *C25D 3/46* (2013.01); *C25D 5/12* (2013.01); *C25D 5/615* (2020.08); *C25D 5/617* (2020.08)

(58) Field of Classification Search
None
See application file for complete search history.

(56) References Cited

U.S. PATENT DOCUMENTS

| | | | | |
|---|---|---|---|---|
| 4,604,167 | A | 8/1986 | Wakabayashi et al. | |
| 2007/0007497 | A1* | 1/2007 | Miyazawa | C25D 3/46 252/500 |
| 2017/0370015 | A1* | 12/2017 | Sadamori | C25D 5/627 |
| 2021/0156044 | A1* | 5/2021 | Takagi | C25D 3/12 |

FOREIGN PATENT DOCUMENTS

| | | | |
|---|---|---|---|
| CN | 104073844 | A * | 10/2014 |
| EP | 4083270 | A1 | 11/2022 |
| JP | H109143786 | A | 6/1997 |
| JP | 2008169408 | A | 7/2008 |
| JP | 2009079250 | A | 4/2009 |
| JP | 2013249514 | A | 12/2013 |
| JP | 2014025093 | A | 2/2014 |
| JP | 2016145413 | A | 8/2016 |
| JP | 2016204719 | A | 12/2016 |
| TW | 201341597 | A | 10/2013 |
| WO | 2004048646 | A1 | 6/2004 |
| WO | 2016121312 | A1 | 8/2016 |

OTHER PUBLICATIONS

Machine translation of Wang CN 104073844 A (Year: 2014).*
Theivasanthi et al. "Electrolytic Synthesis and Characterizations of Silver Nanopowder" (Year: 2011).*
InstaNano; https://instanano.com/all/characterization/xrd/crystallite-size/ (Year: 2024).*
International Search Report dated Jun. 8, 2021 for corresponding application PCT/JP2021/012311.
Extended European Search Report dated Jun. 5, 2024 issued in corresponding application EP21868925.5.

* cited by examiner

*Primary Examiner* — Wojciech Haske
(74) *Attorney, Agent, or Firm* — Bachman & LaPointe, P.C.

(57) ABSTRACT

There are provided a silver-plated product having a more excellent wear resistance than that of conventional silver-plated products, and a method for producing the same. The method comprises the steps of: preparing a silver-plating solution which is an aqueous solution containing silver potassium cyanide or silver cyanide, potassium cyanide or sodium cyanide, and a benzothiazole or a derivative thereof; and forming a surface layer of silver on a base material by electroplating at a liquid temperature and at a current density in the silver-plating solution so as to satisfy $(BC/A)^2/D \geq 10$ ($° C.^2 \cdot dm^2/A$) assuming that a concentration of free cyanide in the silver-plating solution is A (g/L), that a concentration of a benzothiazole content of the benzothiazole or derivative thereof in the silver-plating solution is B (g/L), that the liquid temperature of the silver-plating solution is C (° C.) and that the current density during the electroplating is D ($A/dm^2$).

19 Claims, No Drawings

SILVER-PLATED PRODUCT AND METHOD FOR PRODUCING SAME

BACKGROUND OF THE INVENTION

The present invention generally relates to a silver-plated product and a method for producing the same. More specifically, the invention relates to a silver-plated product used as the material of contact and terminal parts, such as connectors, switches and relays, which are used for on-vehicle and/or household electric wiring, and a method for producing the same.

As conventional materials of contact and terminal parts, such as connectors and switches, there are used plated products wherein a base material of copper, a copper alloy, stainless steel or the like, which are relatively inexpensive and which have excellent corrosion resistance, mechanical characteristics and so forth, is plated with tin, silver, gold or the like in accordance with required characteristics, such as electrical and soldering characteristics.

Tin-plated products obtained by plating a base material of copper, a copper alloy, stainless steel or the like, with tin are inexpensive, but they do not have good corrosion resistance in a high-temperature environment. Gold-plated products obtained by plating such a base material with gold have excellent corrosion resistance and high reliability, but the costs thereof are high. On the other hand, silver-plated products obtained by plating such a base material with silver are inexpensive in comparison with gold-plated products and have excellent corrosion resistance in comparison with tin-plated products.

The materials of contact and terminal parts, such as connectors and switches, are also required to have good wear resistance against the insertion and extraction of connectors and/or the sliding movements of switches.

However, silver-plated products are soft and easy to wear. For that reason, if the silver-plated product is used as the material of a connecting terminal or the like, there is a problem in that the insertion and extraction and/or the sliding movement cause the adhesion thereof to easily cause the adhesive abrasion thereof. There is also a problem in that the surface of the connecting terminal is shaved to enhance the coefficient of friction thereof to enhance the insertion force thereof when the connecting terminal is inserted.

In order to solve such problems, there are known a method for producing a silver-plated product by forming a surface layer of silver on a base material by electroplating in a silver plating solution which contains 80 to 130 g/L of silver, 60 to 130 g/L of potassium cyanide, 30 to 80 mg/L of selenium and 50 to 190 g/L of potassium carbonate (see, e.g., Patent Document 1), and a method for producing a silver-plated product by forming a surface layer of silver on a base material by electroplating in a silver plating solution, which contains 80 to 110 g/L of silver, 70 to 160 g/L of potassium cyanide and 55 to 70 mg/L of selenium, so as to satisfy $(32.6\times-300)\leq y\leq(32.6\times+200)$ assuming that a product of a concentration of potassium cyanide in the silver plating solution and a current density is y (g A/L·dm$^2$) and that a liquid temperature of the silver plating solution is x (° C.) (see, e.g., Patent Document 2).

However, there is some possibility that the wear resistance of the silver-plated products produced by the methods of Patent Documents 1 and 2 is not sufficient, so that it is desired to provide a silver-plated product having a more excellent wear resistance.

On the other hand, there is a problem in that the grain size of the silver-plating film of a silver-plated product is easily increased by recrystallization, so that the increase of the grain size decreases the hardness of the silver-plated product to deteriorate the wear resistance thereof (see, e.g., Patent Document 3).

In order to improve the wear resistance of such a silver-plated product, there is known a method for improving the hardness of the silver-plated product by causing the silver-plating film thereof to contain an element, such as antimony (see, e.g., Patent Document 4).

PRIOR ART DOCUMENT(S)

Patent Document(s)

Patent Document 1: JP 2016-204719 A (Paragraph Numbers 0010)

Patent Document 2: JP 2016-145413 A (Paragraph Numbers 0010)

Patent Document 3: JP 2008-169408 A (Paragraph Numbers 0006)

Patent Document 4: JP 2009-79250 A (Paragraph Numbers 0003-0004)

SUMMARY OF THE INVENTION

However, if the silver-plating film is caused to contain an element, such as antimony, as the method of Patent Document 4, the improvement of the wear resistance is not sufficient although silver is alloyed to improve the hardness thereof. For that reason, it is desired to provide a silver-plated product having a more excellent wear resistance.

It is therefore an object of the present invention to eliminate the aforementioned conventional problems and to provide a silver-plated product having a more excellent wear resistance than that of conventional silver-plated products, and a method for producing the same.

In order to accomplish the aforementioned object, the inventors have diligently studied and found that it is possible to produce a silver-plated product having a more excellent wear resistance than that of conventional silver-plated products, if the silver-plated product is produced by a method for producing a silver-plated product, the method comprising the steps of: preparing a silver-plating solution which is an aqueous solution containing silver potassium cyanide or silver cyanide, potassium cyanide or sodium cyanide, and a benzothiazole or a derivative thereof; and forming a surface layer of silver on a base material by electroplating at a liquid temperature and at a current density in the silver-plating solution so as to satisfy $(BC/A)^2/D\geq10$ (° C.$^2$·dm$^2$/A) assuming that a concentration of free cyanide in the silver-plating solution is A (g/L), that a concentration of a benzothiazole content of the benzothiazole or derivative thereof in the silver-plating solution is B (g/L), that the liquid temperature of the silver-plating solution is C (° C.) and that the current density during the electroplating is D (A/dm$^2$). Thus, the inventors have made the present invention.

According to the present invention, there is provided a method for producing a silver-plated product, the method comprising the steps of: preparing a silver-plating solution which is an aqueous solution containing silver potassium cyanide or silver cyanide, potassium cyanide or sodium cyanide, and a benzothiazole or a derivative thereof; and forming a surface layer of silver on a base material by electroplating at a liquid temperature and at a current density in the silver-plating solution so as to satisfy $(BC/A)^2/D\geq10$ (° C.$^2$·dm$^2$/A) assuming that a concentration of free cyanide in the silver-plating solution is A (g/L), that a concentration of a benzothiazole content of the benzothiazole or derivative thereof in the silver-plating solution is B (g/L), that the liquid temperature of the silver-plating solution is C (° C.) and that the current density during the electroplating is D ($A/dm^2$).

In this method for producing a silver-plated product, the concentration of free cyanide in the silver-plating solution is preferably 3 to 60 g/L, and the concentration of the benzothiazole content in the silver-plating solution is preferably 2 to 30 g/L. The concentration of silver in the silver-plating solution is preferably 15 to 85 g/L. The benzothiazole is preferably a mercaptobenzothiazole. The derivative of the benzothiazole is preferably an alkali metallic salt of the benzothiazole, and the alkali metallic salt is preferably a sodium salt. The electroplating is preferably carried out at a liquid temperature of 15 to 50° C., and the electroplating is preferably carried out at a current density of 0.5 to 10 $A/dm^2$. The base material is preferably made of copper or a copper alloy, and an underlying layer of nickel is preferably formed between the base material and the surface layer.

According to the present invention, there is provided a silver-plated product comprising: a base material; and a surface layer of silver which is formed on the base material, the surface layer of silver having an average crystallite size of not greater than 25 nm and having a Vickers hardness HV of 100 to 160.

In this silver-plated product, the Vickers hardness HV is preferably not higher than 145. The surface layer is preferably made of silver of 95 to 99% by weight, and the surface layer preferably contains 0.5 to 2% by weight of carbon. The base material is preferably made of copper or a copper alloy, and an underlying layer of nickel is preferably formed between the base material and the surface layer. The surface layer preferably contains a benzothiazole content.

Throughout the specification, the expression "benzothiazole content" is a portion corresponding to benzothiazole ($C_7H_5NS$) (molecular weight=135.19).

According to the present invention, it is possible to provide a silver-plated product having a more excellent wear resistance than that of conventional silver-plated products, and a method for producing the same.

DETAILED DESCRIPTION

The preferred embodiment of a method for producing a silver-plated product according to the present invention is a method for producing a silver-plated product, the method comprising the steps of: preparing a silver-plating solution which is an aqueous solution containing silver potassium cyanide or silver cyanide, potassium cyanide or sodium cyanide, and a benzothiazole or a derivative thereof; and forming a surface layer of silver on a base material by electroplating at a liquid temperature and at a current density in the silver-plating solution so as to satisfy $(BC/A)^2/D \geq 10$ (° $C.^2 \cdot dm^2/A$) assuming that a concentration of free cyanide in the silver-plating solution is A (g/L), that a concentration of a benzothiazole content of the benzothiazole or derivative thereof in the silver-plating solution is B (g/L), that the liquid temperature of the silver-plating solution is C (° C.) and that the current density during the electroplating is D ($A/dm^2$).

Furthermore, benzothiazole ($C_7H_5NS$) is a heterocyclic compound having a benzene skeleton and a thiazole skeleton. The benzothiazole is preferably a benzothiazole having a mercapto group (—SH), such as 2-mercaptobenzothiazole. As the derivative of the benzothiazole, there may be used sodium 2-mercaptobenzothiazole (sodium mercaptobenzothiazole (SMBT)), zinc 2-mercaptobenzothiazole, 5-chrolo-2-mercaptobenzothiazole, 6-amino-2-mercaptobenzothiazole, 6-nitro-2-mercaptobenzothiazole, 2-mercapto-5-methoxybenzothiazole or the like. The derivative of the benzothiazole is preferably an alkali metallic salt of the benzothiazole, and the alkali metallic salt of the benzothiazole is preferably a sodium salt of the benzothiazole, such as sodium 2-mercaptobenzothiazole (sodium mercaptobenzothiazole (SMBT)). The concentration of free cyanide in the silver-plating solution can be obtained from the dropping amount of an aqueous solution of silver nitrite when it is dropped in a silver-plating solution, to which an aqueous solution of potassium iodide is added after the silver-plating solution is diluted with water, until the silver-plating solution becomes clouded.

If a benzothiazole (such as a mercaptobenzothiazole) or an alkali metallic salt (preferably sodium salt) thereof is thus added to a (cyanide-containing) silver-plating solution as an organic addition agent to carry out electroplating (silver-plating) therein, it is considered that it is possible to incorporate (at least a part of) the organic addition agent into the surface layer of silver to suppress the crystal grain growth of silver in the surface layer (to miniaturize crystal grains of silver in the surface layer) to enhance the hardness of the surface layer to improve the wear resistance thereof while decreasing the coefficient of friction of the surface layer by the lubricating effect of the organic addition agent. Furthermore, if the mercaptobenzothiazole is used as the benzothiazole, it is possible to improve the production efficiency of the silver-plated product. If the organic addition agent is thus incorporated into the surface layer of silver, when the silver-plated product is used as the material of a connecting terminal or like, it is possible to suppress the adhesion due to the insertion and extraction and/or the sliding movement to improve the wear resistance thereof. In particular, if the electroplating is carried out by the above-described conditions, it is possible to produce a silver-plated product having a more excellent wear resistance than that of conventional silver-plated products.

In the above-described method for producing a silver-plated product, the concentration of free cyanide in the silver-plating solution is preferably 3 to 60 g/L (more preferably 4 to 57 g/L, most preferably 4 to 40 g/L), and the concentration of the benzothiazole content in the silver-plating solution is preferably 2 to 30 g/L (more preferably 2.5 to 25 g/L, still more preferably 5 to 22 g/L, most preferably 7 to 20 g/L). The concentration of silver in the silver-plating solution is preferably 15 to 85 g/L (more preferably 20 to 82 g/L). The concentration of silver potassium cyanide or silver cyanide in the silver-plating solution is preferably 30 to 170 g/L (more preferably 35 to 150 g/L), and the concentration of potassium cyanide or sodium cyanide in the silver-plating solution is preferably 30 to 150 g/L (more preferably 35 to 145 g/L, most preferably 38 to 100 g/L). The concentration of the benzothiazole or alkali metallic salt thereof is preferably 3 to 30 g/L (more preferably 6 to 27 g/L, most preferably 8 to 27 g/L). The electroplating (silver-plating) is preferably carried out at a liquid temperature of to 50° C. and more preferably carried out at a liquid temperature of 18 to 47° C. The electroplating (silver-plating) is preferably carried out at a current density of 0.5 to 10 $A/dm^2$ and more preferably carried out at a current density of 0.5 to 8 $A/dm^2$. Furthermore, in order to form a good silver-plating film, the current density is preferably a relatively high current density of not lower than 1.5 $A/dm^2$, and more preferably not lower than 2.5 $A/dm^2$. The base material is preferably made of copper or a copper alloy, and an underlying layer (of copper, nickel or an alloy thereof) is preferably formed between the base material and the surface layer.

The preferred embodiment of a silver-plated product according to the present is a silver-plated product comprises: a base material; and a surface layer of silver which is formed on the base material, wherein the surface layer (having a thickness of preferably 2 to 10 μm, more preferably 3 to 8 μm) of silver has an average crystallite size of not greater than 25 nm (preferably 8 to 15 nm) and has a Vickers hardness HV of 100 to 160 (preferably 105 to 145).

In this silver-plated product, the surface layer is preferably made of silver of 95 to 99% by weight, and the content of carbon in the surface layer is preferably 0.5 to 2% by weight. The content of sulfur in the surface layer is preferably 0.2 to 2% by weight. The base material is preferably made of copper or a copper alloy, and an underlying layer of nickel having a thickness of 0.3 to 2 μm is preferably formed between the base material and the surface layer.

In this silver-plated product, the surface layer is preferably made of silver of 95 to 99% by weight and more preferably made of silver of 96 to 98.5% by weight. The content of carbon in the surface layer is preferably 0.5 to 2% by weight and more preferably 0.8 to 2% by weight. The base material is preferably made of copper or a copper alloy, and an underlying layer (of copper, nickel or an alloy thereof) is preferably formed between the base material and the surface layer.

EXAMPLES

Examples of a silver-plated product and a method for producing the same according to the present invention will be described below in detail.

Example 1

First, a rolled sheet of oxygen-free copper (C1020 1/2H) having a size of 67 mm×50 mm×0.3 mm was prepared as a base material (a material to be plated). As the pretreatment of the material, the material and a SUS plate were put in an alkali degreasing solution to be used as a cathode and an anode, respectively, to electrolytic-degreasing the material at 5 V for 30 seconds. The material thus electrolytic-degreased was washed with water, and then, pickled for 15 seconds in a 3% sulfuric acid.

Then, the material thus pretreated and a nickel electrode plate were used as a cathode and an anode, respectively, to electroplate (dull-nickel-plate) the material at a liquid temperature of 50° C. and at a current density of 5 A/dm$^2$ for 80 seconds in an aqueous dull-nickel-plating solution containing 540 g/L of nickel sulfamate tetrahydrate, 25 g/L of nickel chloride and 35 g/L of boric acid, while stirring the solution at 500 rpm by means of a stirrer. After a dull-nickel-plating film was thus formed as an underlying plating film, the thickness of the substantially central portion of the dull-nickel-plating film was measured by means of an X-ray fluorescent analysis thickness meter (SFT-110A produced by Hitachi High-Tech Science Corporation). As a result, the thickness was 1 μm.

Then, the material having the underlying plating film and a titanium electrode plate coated with platinum were used as a cathode and an anode, respectively, to electroplate the material at a room temperature (25° C.) and at a current density of 1.4 A/dm$^2$ for 10 seconds in an aqueous silver strike plating solution containing 3 g/L of silver potassium cyanide ($KAg(CN)_2$) and 90 g/L of potassium cyanide (KCN), while stirring the solution at 500 rpm by means of a stirrer. After a silver strike plating film was thus formed, the silver-strike-plated material was washed with water for sufficiently washing away the silver strike plating solution.

Then, the silver-strike-plated material and a silver electrode plate were used as a cathode and an anode, respectively, to electroplate (silver-plate) the material at a liquid temperature of 25° C. and at a current density of 0.7 A/dm$^2$ for 780 seconds in an aqueous silver-plating solution containing 40 g/L of silver potassium cyanide ($KAg(CN)_2$), 39 g/L of potassium cyanide (KCN) and 4 g/L of sodium 2-mercaptobenzothiazole (sodium mercaptobenzothiazole (SMBT)) (a silver-plating solution containing 21.7 g/L of silver, 15.6 g/L of free cyanide and 2.9 g/L of benzothiazole content (BT)) while stirring the solution at 500 rpm by means of a stirrer. The thickness of the substantially central portion of the silver-plating film of the silver-plated product thus formed was measured by means of the above-described X-ray fluorescent analysis thickness meter. As a result, the thickness was 5 μm. Furthermore, assuming that the concentrations of free cyanide and benzothiazole content in the silver-plating solution during the formation of the silver-plating film of the silver-plated product were A (g/L) and B (g/L), respectively, that the temperature of the silver-plating solution was C (° C.) and that the current density during the electroplating was D (A/dm$^2$), $(BC/A)^2/D$ was 30.9 (° C.$^2$ dm$^2$/A).

The Vickers hardness HV of the silver-plated product thus obtained was measured in accordance with JIS Z2244 by applying a measuring load of 10 gf for 10 seconds using a micro-hardness testing machine (HM-221 produced by Mitutoyo Corporation). As a result, the Vickers hardness HV was 157.

Two silver-plated products, each of which was the same as the above-described silver-plated product, were prepared, one of the silver-plated products being indented (Inside R=1.5 mm) to be used as an indenter, and the other of the silver-plated products being used as a plate-shaped evaluation sample. Then, the wear resistance of the evaluation sample was evaluated by carrying out an abrasion test for confirming the abrasion status of the evaluation sample by observing the central portion of the sliding scratch of the evaluation sample at a magnification of 100 by means of a microscope (VHX-1000 produced by Keyence Corporation) when the reciprocating sliding movement (sliding distance=5 mm, sliding speed=1.67 mm/s) was continued until the base material was exposed while the indenter was pushed against the evaluation sample at a constant load (5N) by means of a precision sliding testing apparatus (CRS-G2050-DWA produced by Yamasaki-Seiki Laboratory Co., Ltd.). As a result, it was confirmed that the base material was not exposed after the reciprocating sliding movement was repeated 1,000 times, so that it was found that the wear resistance thereof was good.

The crystallite sizes in vertical directions to each crystal plane of (111), (200), (220) and (311) planes of the silver-plating film of the silver-plated product were calculated by the Scherrer's equation from the full-width at half maximum of each of peaks ((111) peak appearing at about 38°, (200) peak appearing at about 44°, (220) peak appearing at about 64° and (311) peak appearing at about 77°) on the crystal planes on an X-ray diffraction pattern (XRD pattern) obtained by means of an X-ray diffractometer (Full-Automatic Multi-Purpose Horizontal X-ray diffractometer, Smart Lab produced by RIGAKU Corporation). The calculated crystallite sizes were weighted on the basis of the orientation ratio of each of the crystal planes to calculate an average crystallite size by the weighted average of the crystallite sizes on the crystal planes. As a result, the average crystallite size of the silver-plating film was 128.7 angstroms (12.87 nm). Furthermore, as the above-described orientation ratio, there was used a value (corrected intensity) which was corrected by dividing each of the X-ray diffraction peak intensities (the intensities at X-ray diffraction peaks) on the (111), (200), (220) and (311) planes of the silver-plating film by each of the relative intensity ratios (the relative intensity ratios during the measurement of powder) described on JCPDS card No. 40783 ((111):(200):(220):(311)=100:40:25:26), the X-ray diffraction peak intensities being obtained from the X-ray diffraction pattern obtained by scanning in a scanning field 2 θ/θ using a Cu tube and a K β a filter method by means of an X-ray diffractometer (XRD) (Full-Automatic Multi-Purpose Horizontal X-ray diffractometer, Smart Lab produced by RIGAKU Corporation).

Example 2

A silver-plated product was produced by the same method as that in Example 1, except that the amount of sodium 2-mercaptobenzothiazole (SMBT) in the silver-plating solution was 10 g/L (the concentration of benzothiazole content (BT) was 7.1 g/L). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 184.9 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 130. It was confirmed that the base material was not exposed after the reciprocating sliding movement was repeated 10,000 times, so that it was found that the wear resistance thereof was good. The average crystallite size of the silver-plating film was 134.0 angstroms (13.40 nm).

Example 3

A silver-plated product was produced by the same method as that in Example 2, except that the electroplating (silver-plating) for forming the silver-plating film was carried out at a current density of 3 $A/dm^2$ for 180 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 43.2 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 120. It was confirmed that the base material was not exposed after the reciprocating sliding movement was repeated 20,000 times, so that it was found that the wear resistance thereof was good. The average crystallite size of the silver-plating film was 110.1 angstroms (11.01 nm).

Example 4

A silver-plated product was produced by the same method as that in Example 2, except that the electroplating (silver-plating) for forming the silver-plating film was carried out at a current density of 5 $A/dm^2$ for 120 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 25.9 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 137. It was confirmed that the base material was not exposed after the reciprocating sliding movement was repeated 1,000 times, so that it was found that the wear resistance thereof was good. The average crystallite size of the silver-plating film was 102.4 angstroms (10.24 nm).

Example 5

A silver-plated product was produced by the same method as that in Example 1, except that the amount of sodium 2-mercaptobenzothiazole (SMBT) in the silver-plating solution was 15 g/L (the concentration of benzothiazole content (BT) was 10.7 g/L) and that the electroplating (silver-plating) for forming the silver-plating film was carried out at a current density of 4 $A/dm^2$ for 150 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 73.5 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 127. It was confirmed that the base material was not exposed after the reciprocating sliding movement was repeated 1,000 times, so that it was found that the wear resistance thereof was good. The average crystallite size of the silver-plating film was 103.3 angstroms (10.33 nm).

Example 6

A silver-plated product was produced by the same method as that in Example 5, except that the electroplating (silver-plating) for forming the silver-plating film was carried out at a current density of 5 $A/dm^2$ for 120 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 58.8 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 136. It was confirmed that the base material was not exposed after the reciprocating sliding movement was repeated 1,000 times, so that it was found that the wear resistance thereof was good. The average crystallite size of the silver-plating film was 112.1 angstroms (11.21 nm).

Example 7

A silver-plated product was produced by the same method as that in Example 4, except that the amount of silver potassium cyanide ($KAg(CN)_2$) in the silver-plating solution was 80 g/L (the concentration of silver was 43.4 g/L) and that the electroplating (silver-plating) for forming the silver-plating film was carried out at a liquid temperature of 35° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 50.7 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 122. It was confirmed that the base material was not exposed after the reciprocating sliding movement was repeated 1,000 times, so that it was found that the wear resistance thereof was good. The average crystallite size of the silver-plating film was 89.1 angstroms (8.91 nm).

Example 8

A silver-plated product was produced by the same method as that in Example 7, except that the electroplating (silver-plating) for forming the silver-plating film was carried out at a liquid temperature of 40° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 66.3 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 141. It was confirmed that the base material was not exposed after the reciprocating sliding movement was repeated 1,000 times, so that it was found that the wear resistance thereof was good. The average crystallite size of the silver-plating film was 83.6 angstroms (8.36 nm).

Example 9

A silver-plated product was produced by the same method as that in Example 8, except that the electroplating (silver-plating) for forming the silver-plating film was carried out at a current density of 7 $A/dm^2$ for 85 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 47.3 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 125. It was confirmed that the base material was not exposed after the reciprocating sliding movement was repeated 1,000 times, so that it was found that the wear resistance thereof was good. The average crystallite size of the silver-plating film was 91.7 angstroms (9.17 nm).

Example 10

A silver-plated product was produced by the same method as that in Example 6, except that the amount of silver potassium cyanide ($KAg(CN)_2$) in the silver-plating solution was 80 g/L (the concentration of silver was 43.4 g/L). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 58.8 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 126. It was confirmed that the base material was not exposed after the reciprocating sliding movement was repeated 1,000 times, so that it was found that the wear resistance thereof was good. The average crystallite size of the silver-plating film was 95.0 angstroms (9.50 nm).

Example 11

A silver-plated product was produced by the same method as that in Example 10, except that the electroplating (silver-plating) for forming the silver-plating film was carried out at a current density of 3 $A/dm^2$ for 180 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 98.0 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 122. It was confirmed that the base material was not exposed after the reciprocating sliding movement was repeated 1,000 times, so that it was found that the wear resistance thereof was good. The average crystallite size of the silver-plating film was 98.8 angstroms (9.88 nm).

Example 12

A silver-plated product was produced by the same method as that in Example 10, except that the amount of sodium 2-mercaptobenzothiazole (SMBT) in the silver-plating solution was 20 g/L (the concentration of benzothiazole content (BT) was 14.3 g/L). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 105.0 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 114. It was confirmed that the base material was not exposed after the reciprocating sliding movement was repeated 1,000 times, so that it was found that the wear resistance thereof was good. The average crystallite size of the silver-plating film was 73.3 angstroms (7.33 nm).

Example 13

A silver-plated product was produced by the same method as that in Example 12, except that the electroplating (silver-plating) for forming the silver-plating film was carried out at a liquid temperature of 30° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 151.3 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 123. It was confirmed that the base material was not exposed after the reciprocating sliding movement was repeated 1,000 times, so that it was found that the wear resistance thereof was good. The average crystallite size of the silver-plating film was 87.5 angstroms (8.75 nm).

Then, the content of silver in the silver-plating film was calculated as $(Y/X)\times100$ assuming that X was the weight of the silver-plating film and Y was the weight of silver in the silver-plating film. The weight X of the silver-plating film was calculated by subtracting the weight of the base material (the weight of the base material before the formation of the silver-plating film) from the weight of the silver-plated product. The weight Y of silver in the silver-plating film was calculated as follows. First, after silver in the silver-plated product was dissolved in nitric acid, hydrochloric acid was added thereto until the generation of a white precipitate (AgCl) was completed. Then, after the while precipitate was filtrated and washed with water, the weight of AgCl was measured to calculate the weight Y of silver in the silver-plating film. The content of carbon in the silver-plated product was calculated by qualitatively and quantitatively measuring CO and $CO_2$, which were produced when the silver-plated product was heated to 1350° C. in an oxygen gas stream to be melted, by an infrared detector by means of a carbon/sulfur analyzer (EMIA-810 produced by HORIBA, Ltd.). Furthermore, the content of carbon in the silver-plated product was regarded as the content of carbon in the silver-plating film, since the content of carbon in the base material before the formation of the silver-plating film was not greater than detection limit although it was calculated. The content of sulfur in the silver-plated product was calculated as the content of sulfur in the silver-plating film by qualitatively and quantitatively measuring $SO_2$, which was produced when the silver-plated product was heated to 1350° C. in an oxygen gas stream to be melted, by the infrared detector. The content of nitrogen in the silver-plated product was calculated as the content of nitrogen in the silver-plating film by quantitatively measuring $N_2$, which was produced when the silver-plated product was melted in a helium gas stream by an electric power of 5000 W, by a thermal conductivity detector (TCD) by means of an oxygen/nitrogen/hydrogen analyzer (LECO JAPAN CORPORATION). As a result, the silver-plating film was a film containing 1.0% by weight of carbon, 0.6% by weight of sulfur, 0.2% by weight of nitrogen and 98.2% by weight of silver. Furthermore, from the results obtained by analyzing the silver-plating film by means of the carbon/sulfur analyzer (EMIA-810 produced by HORIBA, Ltd.) and the oxygen/nitrogen/hydrogen analyzer (LECO JAPAN CORPORATION), the ratios of atomic concentrations in the silver-plating film were C/S=4 and S/N=2, and it was presumed to be equivalent (C/N=about 3-6, S/N=about 1-4) to the theoretical ratios (C/S=3.5, S/N=2) of a benzothiazole, so that it was found that a benzothiazole content was contained in the silver-plating film.

Example 14

A silver-plated product was produced by the same method as that in Example 12, except that the electroplating (silver-plating) for forming the silver-plating film was carried out at a liquid temperature of 35° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 205.9 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 129. It was confirmed that the base material was not exposed after the reciprocating sliding movement was repeated 1,000 times, so that it was found that the wear resistance thereof was good. The average crystallite size of the silver-plating film was 95.3 angstroms (9.53 nm).

Example 15

A silver-plated product was produced by the same method as that in Example 12, except that the electroplating (silver-plating) for forming the silver-plating film was carried out at a liquid temperature of 40° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 268.9 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 131. It was confirmed that the base material was not exposed after the reciprocating sliding movement was repeated 1,000 times, so that it was found that the wear resistance thereof was good. The average crystallite size of the silver-plating film was 104.7 angstroms (10.47 nm).

Example 16

A silver-plated product was produced by the same method as that in Example 12, except that the electroplating (silver-plating) for forming the silver-plating film was carried out at a liquid temperature of 45° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 340.3 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 128. It was confirmed that the base material was not exposed after the reciprocating sliding movement was repeated 1,000 times, so that it was found that the wear resistance thereof was good. The average crystallite size of the silver-plating film was 132.9 angstroms (13.29 nm).

Example 17

A silver-plated product was produced by the same method as that in Example 16, except that the electroplating (silver-plating) for forming the silver-plating film was carried out at a current density of 7 $A/dm^2$ for 85 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 243.1 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 131. It was confirmed that the base material was not exposed after the reciprocating sliding movement was repeated 1,000 times, so that it was found that the wear resistance thereof was good. The average crystallite size of the silver-plating film was 90.1 angstroms (9.01 nm).

The surface analysis of the silver-plating film of the silver-plated product was carried out by the same method as that in Example 13. As a result, the silver-plating film was a film containing 1.9% by weight of carbon, 1.3% by weight of sulfur, 0.2% by weight of nitrogen and 96.5% by weight of silver. Furthermore, from the results obtained by analyzing the silver-plating film by the same method as that in Example 13, the ratios of atomic concentrations in the silver-plating film were C/S=4 and S/N=3, so that it was found that a benzothiazole content was contained in the silver-plating film.

Example 18

A silver-plated product was produced by the same method as that in Example 16, except that the amount of potassium cyanide (KCN) in the silver-plating solution was 78 g/L (the concentration of free cyanide was 31.1 g/L) and that the amount of sodium 2-mercaptobenzothiazole (SMBT) in the silver-plating solution was 25 g/L (the concentration of benzothiazole content (BT) was 17.9 g/L). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 134.2 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 120. It was confirmed that the base material was not exposed after the reciprocating sliding movement was repeated 1,000 times, so that it was found that the wear resistance thereof was good. The average crystallite size of the silver-plating film was 102.9 angstroms (10.29 nm).

Example 19

A silver-plated product was produced by the same method as that in Example 18, except that the amount of silver potassium cyanide ($KAg(CN)_2$) in the silver-plating solution was 148 g/L (the concentration of silver was 80.2 g/L) and that the amount of potassium cyanide (KCN) in the silver-plating solution was 140 g/L (the concentration of free cyanide was 55.9 g/L). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 41.5 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 128. It was confirmed that the base material was not exposed after the reciprocating sliding movement was repeated 1,000 times, so that it was found that the wear resistance thereof was good. The average crystallite size of the silver-plating film was 93.1 angstroms (9.31 nm).

The surface analysis of the silver-plating film of the silver-plated product was carried out by the same method as that in Example 13. As a result, the silver-plating film was a film containing 1.1% by weight of carbon, 0.6% by weight of sulfur, 0.1% by weight of nitrogen and 98.2% by weight of silver. Furthermore, from the results obtained by analyzing the silver-plating film by the same method as that in Example 13, the ratios of atomic concentrations in the silver-plating film were C/S=5 and S/N=2, so that it was found that a benzothiazole content was contained in the silver-plating film.

Example 20

A silver-plated product was produced by the same method as that in Example 19, except that the electroplating (silver-plating) for forming the silver-plating film was carried out at a current density of 7 $A/dm^2$ for 85 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 29.7 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 134. It was confirmed that the base material was not exposed after the reciprocating sliding movement was repeated 1,000 times, so that it was found that the wear resistance thereof was good. The average crystallite size of the silver-plating film was 90.6 angstroms (9.06 nm).

Example 21

A silver-plated product was produced by the same method as that in Example 12, except that the silver-plating solution was an aqueous silver-plating solution containing 54 g/L of silver cyanide (AgCN), 29 g/L of sodium cyanide (NaCN) and 20 g/L of sodium 2-mercaptobenzothiazole (SMBT) (a silver-plating solution containing 43.5 g/L of silver, 4.9 g/L of free cyanide and 14.3 g/L of benzothiazole content (BT)) and that the electroplating (silver-plating) for forming the silver-plating film was carried out at a current density of 5 $A/dm^2$ for 180 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 1064.6 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 131. It was confirmed that the base material was not exposed after the reciprocating sliding movement was repeated 1,000 times, so that it was found that the wear resistance thereof was good. The average crystallite size of the silver-plating film was 84.9 angstroms (8.49 nm).

Example 22

A silver-plated product was produced by the same method as that in Example 21, except that the electroplating (silver-plating) for forming the silver-plating film was carried out at a liquid temperature of 40° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 2725.4 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 113. It was confirmed that the base material was not exposed after the reciprocating sliding movement was repeated 1,000 times, so that it was found that the wear resistance thereof was good. The average crystallite size of the silver-plating film was 93.0 angstroms (9.30 nm).

Comparative Example 1

A silver-plated product was produced by the same method as that in Example 1, except that the amount of sodium 2-mercaptobenzothiazole (SMBT) in the silver-plating solution was 2 g/L (the concentration of benzothiazole content (BT) was 1.4 g/L). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 7.2 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 138. It was confirmed that the base material was exposed after the reciprocating sliding movement was repeated 50 times or less, so that it was found that the wear resistance thereof was not good. The average crystallite size of the silver-plating film was 313.1 angstroms (31.31 nm).

Comparative Example 2

A silver-plated product was produced by the same method as that in Example 19, except that the amount of sodium 2-mercaptobenzothiazole (SMBT) in the silver-plating solution was 15 g/L (the concentration of benzothiazole content (BT) was 10.7 g/L) and that the electroplating (silver-plating) for forming the silver-plating film was carried out at a liquid temperature of 25° C. and at a current density of 3 $A/dm^2$ for 180 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 7.6 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 143. It was confirmed that the base material was exposed after the reciprocating sliding movement was repeated 100 times or less, so that it was found that the wear resistance thereof was not good. The average crystallite size of the silver-plating film was 284.7 angstroms (28.47 nm).

Comparative Example 3

A silver-plated product was produced by the same method as that in Comparative Example 2, except that the electroplating (silver-plating) for forming the silver-plating film was carried out at a current density of 5 $A/dm^2$ for 120 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 4.6 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 153. It was confirmed that the base material was exposed after the reciprocating sliding movement was repeated 100 times or less, so that it was found that the wear resistance thereof was not good. The average crystallite size of the silver-plating film was 344.4 angstroms (34.44 nm).

Comparative Example 4

A silver-plated product was produced by the same method as that in Comparative Example 2, except that the electroplating (silver-plating) for forming the silver-plating film was carried out at a current density of 7 A/dm$^2$ for 85 seconds. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 3.3 (° C.$^2$·dm$^2$/A).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 89. It was confirmed that the base material was exposed after the reciprocating sliding movement was repeated 100 times or less, so that it was found that the wear resistance thereof was not good. The average crystallite size of the silver-plating film was 882.0 angstroms (88.20 nm).

Comparative Example 5

A silver-plated product was produced by the same method as that in Example 1, except that 0.8 g/L of 2-mercaptobenzimidazole (2-MBI) was used in place of sodium 2-mercaptobenzothiazole (SMBT) in the silver-plating solution (a silver-plating solution containing 21.7 g/L of silver, 15.6 g/L of free cyanide and 0.8 g/L of 2-mercaptobenzimidazole (2-MBI) was used). The thickness of the substantially central portion of the silver-plating film of the silver-plated product was measured by the same method as that in Example 1, so that the thickness was 5 μm.

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 187. It was confirmed that the base material was exposed after the reciprocating sliding movement was repeated 40 times or less, so that it was found that the wear resistance thereof was not good. The average crystallite size of the silver-plating film was 152.0 angstroms (15.20 nm).

The surface analysis of the silver-plating film of the silver-plated product was carried out by the same method as that in Example 13. As a result, the silver-plating film was a film containing 0.5% by weight of carbon and 99.2% by weight or more of silver.

Comparative Example 6

A silver-plated product was produced by the same method as that in Example 4, except that the silver-plating solution was an aqueous silver-plating solution containing 175 g/L of silver potassium cyanide ($KAg(CN)_2$), 95 g/L of potassium cyanide (KCN) and 70 mg/L of selenium (a silver-plating solution containing 94.9 g/L of silver, 37.9 g/L of free cyanide and 70 mg/L of selenium) and that the electroplating (silver-plating) for forming the silver-plating film was carried out at a liquid temperature of 18 t. The thickness of the substantially central portion of the silver-plating film of the silver-plated product was measured by the same method as that in Example 1, so that the thickness was 5 μm.

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 134. It was confirmed that the base material was exposed after the reciprocating sliding movement was repeated 80 times, so that it was found that the wear resistance thereof was not good. The average crystallite size of the silver-plating film was 278 angstroms (27.8 nm).

The surface analysis of the silver-plating film of the silver-plated product was carried out by the same method as that in Example 13. As a result, the silver-plating film was a film containing 0.1% by weight or less of carbon and 99.9% by weight or more of silver.

Comparative Example 7

A silver-plated product was produced by the same method as that in Example 1, except that the silver-plating solution was an aqueous silver-plating solution containing 148 g/L of silver potassium cyanide ($KAg(CN)_2$), 140 g/L of potassium cyanide (KCN) and 8 mg/L of selenium (a silver-plating solution containing 80.2 g/L of silver, 55.9 g/L of free cyanide and 8 mg/L of selenium) and that the electroplating (silver-plating) for forming the silver-plating film was carried out at a liquid temperature of 16 t and at a current density of 8 A/dm$^2$ for 75 seconds. The thickness of the substantially central portion of the silver-plating film of the silver-plated product was measured by the same method as that in Example 1, so that the thickness was 5 μm.

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 82. It was confirmed that the base material was exposed after the reciprocating sliding movement was repeated 50 times, so that it was found that the wear resistance thereof was not good. The average crystallite size of the silver-plating film was 750 angstroms (75.0 nm).

Comparative Example 8

A silver-plated product was produced by the same method as that in Example 1, except that the silver-plating solution was an aqueous silver-plating solution containing 115 g/L of silver potassium cyanide ($KAg(CN)_2$), 60 g/L of potassium cyanide (KCN) and 40 mg/L of selenium (a silver-plating solution containing 62.3 g/L of silver, 24.0 g/L of free cyanide and 40 mg/L of selenium) and that the electroplating (silver-plating) for forming the silver-plating film was carried out at a current density of 2 A/dm$^2$ for 300 seconds. The thickness of the substantially central portion of the silver-plating film of the silver-plated product was measured by the same method as that in Example 1, so that the thickness was 5 μm.

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 119. It was confirmed that the base material was exposed after the reciprocating sliding movement was repeated 100 times, so that it was found that the wear resistance thereof was not good. The average crystallite size of the silver-plating film was 636 angstroms (63.6 nm).

Comparative Example 9

A silver-plated product was produced by the same method as that in Example 1, except that 1.0 g/L of N-allylthiourea was used in place of sodium 2-mercaptobenzothiazole (SMBT) in the silver-plating solution (a silver-plating solution containing 21.7 g/L of silver, 15.6 g/L of free cyanide and 1.0 g/L of N-allylthiourea was used). The thickness of the substantially central portion of the silver-plating film of the silver-plated product was measured by the same method as that in Example 1, so that the thickness was 5 μm.

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 61. It was confirmed that the base material was exposed after the reciprocating sliding movement was repeated 30 times or less, so that it was found that the wear resistance thereof was not good. The average crystallite size of the silver-plating film was 455.6 angstroms (45.56 nm).

Example 23

A silver-plated product was produced by the same method as that in Example 7, except that 6 g/L of 6-nitro-2-mercaptobenzothiazole (NMBT) was used in place of sodium 2-mercaptobenzothiazole (SMBT) in the silver-plating solution (a silver-plating solution containing 43.4 g/L of silver, 15.6 g/L of free cyanide and 3.8 g/L of a benzothiazole content (BT) was used). The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 14.9 (° $C.^2 \cdot dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 122. It was confirmed that the base material was not exposed after the reciprocating sliding movement was repeated 1,000 times, so that it was found that the wear resistance thereof was good. The average crystallite size of the silver-plating film was 172.5 angstroms (17.25 nm).

Example 24

A silver-plated product was produced by the same method as that in Example 9, except that 6 g/L of 6-nitro-2-mercaptobenzothiazole (NMBT) was used in place of sodium 2-mercaptobenzothiazole (SMBT) in the silver-plating solution (a silver-plating solution containing 43.4 g/L of silver, 15.6 g/L of free cyanide and 3.8 g/L of a benzothiazole content (BT) was used) and that the electroplating (silver-plating) for forming the silver-plating film was carried out at a liquid temperature of 35° C. The thickness of the substantially central portion of the silver-plating film of the silver-plated product was measured by the same method as that in Example 1, so that the thickness was 5 μm. Furthermore, in the formation of the silver-plating film of the silver-plated product, $(BC/A)^2/D$ was 10.7 (° $C.^2$ $dm^2/A$).

With respect to the silver-plated product thus obtained, the measurement of the Vickers hardness HV of the silver-plating film, the evaluation of the wear resistance thereof and the calculation of the crystallite sizes thereof were carried out by the same methods as those in Example 1. As a result, the Vickers hardness HV was 107. It was confirmed that the base material was not exposed after the reciprocating sliding movement was repeated 1,000 times, so that it was found that the wear resistance thereof was good. The average crystallite size of the silver-plating film was 92.4 angstroms (9.24 nm).

The producing conditions and characteristics of the silver-plated products obtained in these examples and comparative examples are shown in Tables 1 through 6.

TABLE 1

| | Silver-Plating Solution | | | | | |
|---|---|---|---|---|---|---|
| | Ag (g/L) | Free Cyanide (g/L) | BT (g/L) | 2-MBI (g/L) | Se (mg/L) | N-allyl-thiourea (g/L) |
| Ex. 1 | 21.7 | 15.6 | 2.9 | — | — | — |
| Ex. 2 | 21.7 | 15.6 | 7.1 | — | — | — |
| Ex. 3 | 21.7 | 15.6 | 7.1 | — | — | — |
| Ex. 4 | 21.7 | 15.6 | 7.1 | — | — | — |
| Ex. 5 | 21.7 | 15.6 | 10.7 | — | — | — |
| Ex. 6 | 21.7 | 15.6 | 10.7 | — | — | — |
| Ex. 7 | 43.4 | 15.6 | 7.1 | — | — | — |
| Ex. 8 | 43.4 | 15.6 | 7.1 | — | — | — |
| Ex. 9 | 43.4 | 15.6 | 7.1 | — | — | — |
| Ex. 10 | 43.4 | 15.6 | 10.7 | — | — | — |
| Ex. 11 | 43.4 | 15.6 | 10.7 | — | — | — |
| Ex. 12 | 43.4 | 15.6 | 14.3 | — | — | — |
| Ex. 13 | 43.4 | 15.6 | 14.3 | — | — | — |
| Ex. 14 | 43.4 | 15.6 | 14.3 | — | — | — |
| Ex. 15 | 43.4 | 15.6 | 14.3 | — | — | — |
| Ex. 16 | 43.4 | 15.6 | 14.3 | — | — | — |
| Ex. 17 | 43.4 | 15.6 | 14.3 | — | — | — |
| Ex. 18 | 43.4 | 31.1 | 17.9 | — | — | — |
| Ex. 19 | 80.2 | 55.9 | 17.9 | — | — | — |
| Ex. 20 | 80.2 | 55.9 | 17.9 | — | — | — |
| Ex. 21 | 43.5 | 4.9 | 14.3 | — | — | — |
| Ex. 22 | 43.5 | 4.9 | 14.3 | — | — | — |
| Ex. 23 | 43.4 | 15.6 | 3.8 | — | — | — |
| Ex. 24 | 43.4 | 15.6 | 3.8 | — | — | — |

TABLE 2

| | Silver-Plating Solution | | | | | |
|---|---|---|---|---|---|---|
| | Ag (g/L) | Free Cyanide (g/L) | BT (g/L) | 2-MBI (g/L) | Se (mg/L) | N-allyl-thiourea (g/L) |
| Comp. 1 | 21.7 | 15.6 | 1.4 | — | — | — |
| Comp. 2 | 80.2 | 55.9 | 10.7 | — | — | — |
| Comp. 3 | 80.2 | 55.9 | 10.7 | — | — | — |
| Comp. 4 | 80.2 | 55.9 | 10.7 | — | — | — |
| Comp. 5 | 21.7 | 15.6 | — | 0.8 | — | — |
| Comp. 6 | 94.9 | 37.9 | — | — | 70 | — |
| Comp. 7 | 80.2 | 55.9 | — | — | 8 | — |
| Comp. 8 | 62.3 | 24.0 | — | — | 40 | — |
| Comp. 9 | 21.7 | 15.6 | — | — | — | 1.0 |

TABLE 3

| | Silver-Plating Solution | | | |
|---|---|---|---|---|
| | Liquid Temp. (° C.) | Current Density (A/dm$^2$) | Time (sec.) | $(BC/A)^2/D$ (° C.$^2$ · dm$^2$)/A |
| Ex. 1 | 25 | 0.7 | 780 | 30.9 |
| Ex. 2 | 25 | 0.7 | 780 | 184.9 |
| Ex. 3 | 25 | 3 | 180 | 43.2 |
| Ex. 4 | 25 | 5 | 120 | 25.9 |
| Ex. 5 | 25 | 4 | 150 | 73.5 |
| Ex. 6 | 25 | 5 | 120 | 58.8 |
| Ex. 7 | 35 | 5 | 120 | 50.7 |
| Ex. 8 | 40 | 5 | 120 | 66.3 |
| Ex. 9 | 40 | 7 | 85 | 47.3 |
| Ex. 10 | 25 | 5 | 120 | 58.8 |
| Ex. 11 | 25 | 3 | 180 | 98.0 |
| Ex. 12 | 25 | 5 | 120 | 105.0 |
| Ex. 13 | 30 | 5 | 120 | 151.3 |
| Ex. 14 | 35 | 5 | 120 | 205.9 |
| Ex. 15 | 40 | 5 | 120 | 268.9 |
| Ex. 16 | 45 | 5 | 120 | 340.3 |
| Ex. 17 | 45 | 7 | 85 | 243.1 |
| Ex. 18 | 45 | 5 | 120 | 134.2 |
| Ex. 19 | 45 | 5 | 120 | 41.5 |
| Ex. 20 | 45 | 7 | 85 | 29.7 |
| Ex. 21 | 25 | 5 | 180 | 1064.6 |
| Ex. 22 | 40 | 5 | 180 | 2725.4 |
| Ex. 23 | 35 | 5 | 120 | 14.9 |
| Ex. 24 | 35 | 7 | 85 | 10.7 |

TABLE 4

| | Silver-Plating Solution | | | |
|---|---|---|---|---|
| | Liquid Temp. (° C.) | Current Density (A/dm$^2$) | Time (sec.) | $(BC/A)^2/D$ (° C.$^2$ · dm$^2$)/A |
| Comp. 1 | 25 | 0.7 | 780 | 7.2 |
| Comp. 2 | 25 | 3 | 180 | 7.6 |
| Comp. 3 | 25 | 5 | 120 | 4.6 |
| Comp. 4 | 25 | 7 | 85 | 3.3 |
| Comp. 5 | 25 | 0.7 | 780 | — |
| Comp. 6 | 18 | 5 | 120 | — |
| Comp. 7 | 16 | 8 | 75 | — |
| Comp. 8 | 25 | 2 | 300 | — |
| Comp. 9 | 25 | 0.7 | 780 | — |

TABLE 5

| | Vickers Hardness HV | Number of Durable Times (Number of Times) | Average Crystallite Size (nm) |
|---|---|---|---|
| Ex. 1 | 157 | not less than 1000 | 12.87 |
| Ex. 2 | 130 | not less than 10000 | 13.40 |
| Ex. 3 | 120 | not less than 20000 | 11.01 |
| Ex. 4 | 137 | not less than 1000 | 10.24 |
| Ex. 5 | 127 | not less than 1000 | 10.33 |
| Ex. 6 | 136 | not less than 1000 | 11.21 |
| Ex. 7 | 122 | not less than 1000 | 8.91 |
| Ex. 8 | 141 | not less than 1000 | 8.36 |
| Ex. 9 | 125 | not less than 1000 | 9.17 |
| Ex. 10 | 126 | not less than 1000 | 9.50 |
| Ex. 11 | 122 | not less than 1000 | 9.88 |
| Ex. 12 | 114 | not less than 1000 | 7.33 |
| Ex. 13 | 123 | not less than 1000 | 8.75 |
| Ex. 14 | 129 | not less than 1000 | 9.53 |
| Ex. 15 | 131 | not less than 1000 | 10.47 |
| Ex. 16 | 128 | not less than 1000 | 13.29 |
| Ex. 17 | 131 | not less than 1000 | 9.01 |
| Ex. 18 | 120 | not less than 1000 | 10.29 |
| Ex. 19 | 128 | not less than 1000 | 9.31 |

TABLE 5-continued

| | Vickers Hardness HV | Number of Durable Times (Number of Times) | Average Crystallite Size (nm) |
|---|---|---|---|
| Ex. 20 | 134 | not less than 1000 | 9.06 |
| Ex. 21 | 131 | not less than 1000 | 8.49 |
| Ex. 22 | 113 | not less than 1000 | 9.30 |
| Ex. 23 | 122 | not less than 1000 | 17.25 |
| Ex. 24 | 107 | not less than 1000 | 9.24 |

TABLE 6

| | Vickers Hardness HV | Number of Durable Times (Number of Times) | Average Crystallite Size (nm) |
|---|---|---|---|
| Comp. 1 | 138 | not greater than 50 | 31.31 |
| Comp. 2 | 143 | not greater than 100 | 28.47 |
| Comp. 3 | 153 | not greater than 100 | 34.44 |
| Comp. 4 | 89 | not greater than 100 | 88.20 |
| Comp. 5 | 187 | not greater than 40 | 15.20 |
| Comp. 6 | 134 | 80 | 27.80 |
| Comp. 7 | 82 | 50 | 75.00 |
| Comp. 8 | 119 | 100 | 63.60 |
| Comp. 9 | 61 | 30 | 45.56 |

The invention claimed is:

1. A silver-plated product comprising:

a base material; and a surface layer of silver which is formed on the base material, the surface layer of silver having an average crystallite size of not greater than 17.25 nm and having a Vickers hardness HV of 100 to 160.

2. A silver-plated product as set forth in claim 1, wherein said Vickers hardness HV is not higher than 145.

3. A silver-plated product as set forth in claim 1, wherein said surface layer is made of silver of 95 to 99% by weight.

4. A silver-plated product as set forth in claim 1, wherein said surface layer contains 0.5 to 2% by weight of carbon.

5. A silver-plated product as set forth in claim 1, wherein said base material is made of copper or a copper alloy.

6. A silver-plated product as set forth in claim 1, wherein an underlying layer of nickel is formed between said base material and said surface layer.

7. A silver-plated product as set forth in claim 1, wherein said surface layer contains a benzothiazole content.

8. A silver-plated product as set forth in claim 1, wherein the ratio (C/S) of atomic concentration of carbon to atomic concentration of sulfur in the surface layer is in the range of from 3 to 6, and the ratio (S/N) of atomic concentration of sulfur to atomic concentration of nitrogen in the surface layer is in the range of from 1 to 4.

9. A method for producing a silver-plated product, the method comprising the steps of:

preparing a silver-plating solution which is an aqueous solution containing silver potassium cyanide or silver cyanide, potassium cyanide or sodium cyanide, and a benzothiazole or a derivative thereof; and forming a surface layer of silver on a base material by electroplating at a liquid temperature and at a current density in the silver-plating solution so as to satisfy $(BC/A)^2/D \geq 10$ (° C.$^2$·dm$^2$/A) assuming that a concentration of free cyanide in the silver-plating solution is A (g/L), that a concentration of a benzothiazole content of the benzothiazole or derivative thereof in the silver-plating solution is B (g/L), that the liquid temperature of the silver-plating solution is C (° C.) and that the current density during the electroplating is D ($A/dm^2$), thus forming the surface layer of silver having an average crystallite size of not greater than 17.25 nm and having a Vickers hardness HV of 100 to 160.

10. A method for producing a silver-plated product as set forth in claim 9, wherein the concentration of free cyanide in the silver-plating solution is 3 to 60 g/L.

11. A method for producing a silver-plated product as set forth in claim 9, wherein the concentration of the benzothiazole content in the silver-plating solution is 2 to 30 g/L.

12. A method for producing a silver-plated product as set forth in claim 9, wherein a concentration of silver in the silver-plating solution is 15 to 85 g/L.

13. A method for producing a silver-plated product as set forth in claim 9, wherein said benzothiazole is a mercaptobenzothiazole.

14. A method for producing a silver-plated product as set forth in claim 9, wherein said derivative of the benzothiazole is an alkali metallic salt of the benzothiazole.

15. A method for producing a silver-plated product as set forth in claim 14, wherein said alkali metallic salt is a sodium salt.

16. A method for producing a silver-plated product as set forth in claim 9, wherein said electroplating is carried out at a liquid temperature of 15 to 50° C.

17. A method for producing a silver-plated product as set forth in claim 9, wherein said electroplating is carried out at a current density of 0.5 to 10 $A/dm^2$.

18. A method for producing a silver-plated product as set forth in claim 9, wherein said base material is made of copper or a copper alloy.

19. A method for producing a silver-plated product as set forth in claim 9, wherein an underlying layer of nickel is formed between said base material and said surface layer.

* * * * *